US010781013B2

(12) United States Patent
Patel et al.

(10) Patent No.: US 10,781,013 B2
(45) Date of Patent: Sep. 22, 2020

(54) STORAGE SYSTEM HAVING STACKABLE AND ENGAGEABLE VESSELS

(71) Applicants: Sesha Patel, Wilmington, NC (US); Shashin Patel, Wilmington, NC (US)

(72) Inventors: Sesha Patel, Wilmington, NC (US); Shashin Patel, Wilmington, NC (US)

( * ) Notice: Subject to any disclaimer, the term of this patent is extended or adjusted under 35 U.S.C. 154(b) by 15 days.

(21) Appl. No.: 16/275,512

(22) Filed: Feb. 14, 2019

(65) Prior Publication Data

US 2020/0262610 A1 Aug. 20, 2020

(51) Int. Cl.

| | |
|---|---|
| ***B65D 21/032*** | (2006.01) |
| ***B65D 21/02*** | (2006.01) |
| ***B65D 1/02*** | (2006.01) |
| ***B67B 3/20*** | (2006.01) |
| ***B65B 1/04*** | (2006.01) |

(52) U.S. Cl.

CPC ..... *B65D 21/0231* (2013.01); *B65B 1/04* (2013.01); *B65D 1/0246* (2013.01); *B67B 3/20* (2013.01)

(58) Field of Classification Search

CPC ..... B65D 21/0233; B65D 21/022; B65D 21/0217; B65D 21/0222; B65D 21/0223

USPC ..... 220/508; 206/508

See application file for complete search history.

(56) References Cited

U.S. PATENT DOCUMENTS 2,077,027 A * 4/1937 Torras ..... B65D 21/0231 206/508

* cited by examiner

*Primary Examiner* — Stephen J Castellano

(74) *Attorney, Agent, or Firm* — Carla Gannon Law

(57) ABSTRACT

A storage system includes a plurality of vessels each shaped to engage with an adjoining vessel in a top-to-bottom orientation. The volume of the vessels may vary. The lip of each vessel includes a plurality of radially positioned flanges, and the bottom of each vessel includes a plurality of radially positioned locking lugs that correspond and engage with the flanges upon rotation of one vessel relative to the other.

11 Claims, 6 Drawing Sheets

STORAGE SYSTEM HAVING STACKABLE AND ENGAGEABLE VESSELS

BACKGROUND OF THE INVENTION

The present invention relates generally to storage systems, and more particularly, to a storage system having stackable and engageable vessels.

It is often desirable to transport, provide and store multiple vessels as a set that can be easily separated for use, and reconnected after use to keep the vessels together as a unit. An example of this is a set of beverages having multiple flavors such as cola, lemon-lime soda and root beer. Another example is a set of hair products that are intended to be used with one another such as shampoo, conditioner and leave-in conditioner. Yet other examples include alcohol and mixers for cocktails; baking materials such as flour and/or cake mixes; and infant formula mixes.

Transporting, providing and storing discrete materials including liquids, fluids, solids and semi-solids in a set usually requires multiple unattached vessels. For example, a beverage kit to make cranberry orange spritzer requires three separate containers: cranberry juice; orange juice; and seltzer. Unfortunately, however, having three separate containers increases the likelihood that one or more of the members will be misplaced. Also, it is more cumbersome to handle separate vessels versus one larger item.

As can be seen, there is a need for an improved storage system that includes multiple vessels configured to be joined together. It is desirable that the vessels can be easily and quickly engaged and disengaged as desired, and that the engagement structures don't interfere with normal usage of the vessels. It is also desirable that the storage system can accommodate as few or as many vessels as desired without modification.

SUMMARY OF THE INVENTION

A storage system includes a plurality of vessels each sized and shaped to engage with an adjoining vessel in a top-to-bottom orientation. In a preferred embodiment the lip of each vessel includes a plurality of radially positioned flanges, and the bottom of each vessel includes a plurality of radially positioned locking lugs that correspond and engage with the flanges. The lip is sized and shaped to be inserted into the depression of an upwardly adjoining vessel, with the flanges and locking lugs engaged upon rotating one vessel relative to the other. In this manner a series of vessels can be engaged one to another in a stackable orientation.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The following structure numbers shall apply to the following structures among the various FIGS.:

10—storage system;
20—vessel;
22—upper vessel;
23—middle vessel;
24—lower vessel;
26—upper portion;
27—upper tapering;
28—lower portion;
29—lower tapering;
30—cap;
35—interior cavity;
40—lip;
41—threads;
42—flange;
44—interflange region;
50—depression;
52—locking lug; and
54—interlug region.

Broadly, the present invention pertains to containers, and, more particularly, to a storage system includes a plurality of vessels each sized and shaped to engage with an adjoining vessel in a top-to-bottom orientation.

As used herein, "materials" shall refer to a broad range of substance having various forms including liquids, fluids, solids and semi-solids.

Figure 1:
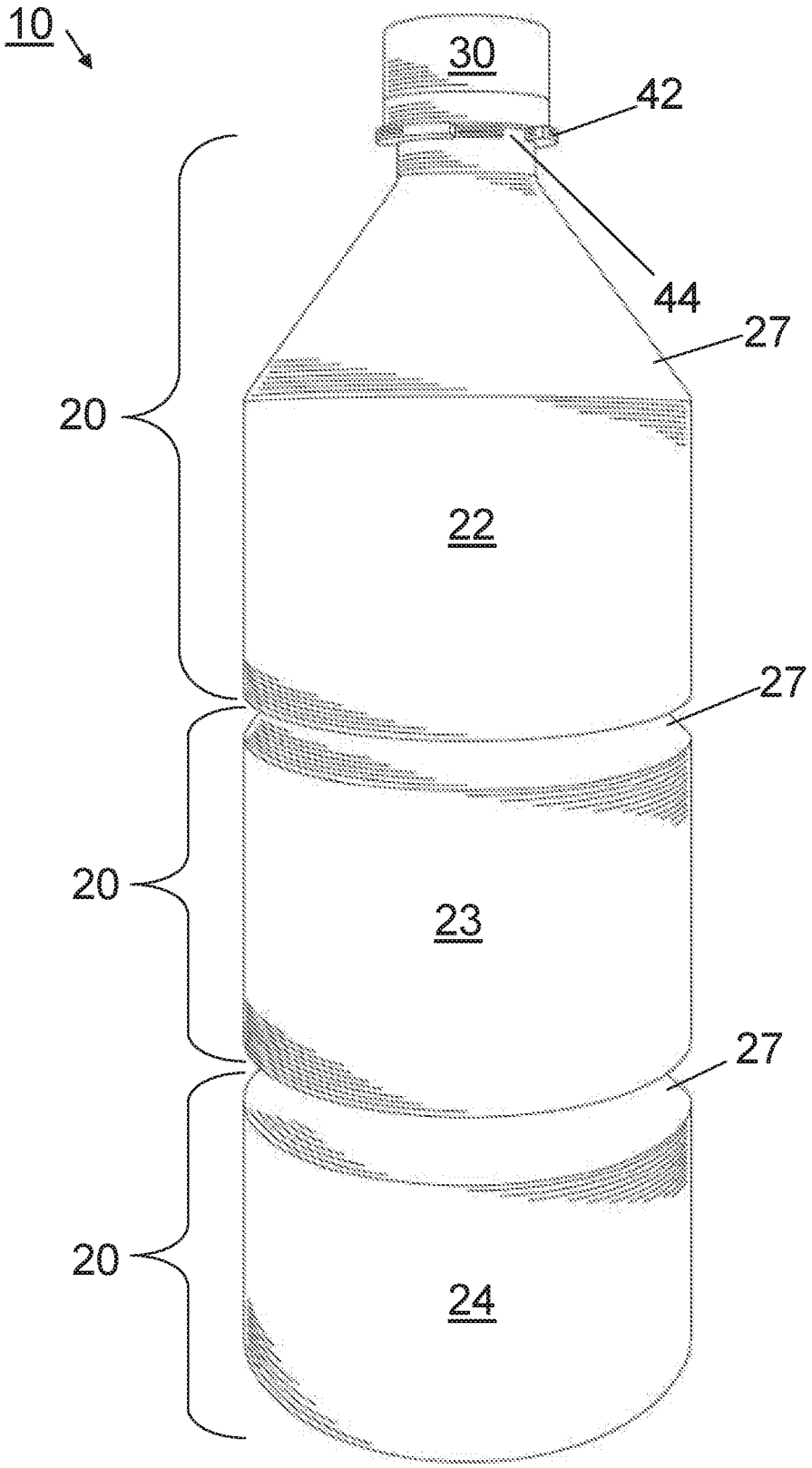
FIG. 1 is a perspective view of a storage system.
Figure 2:
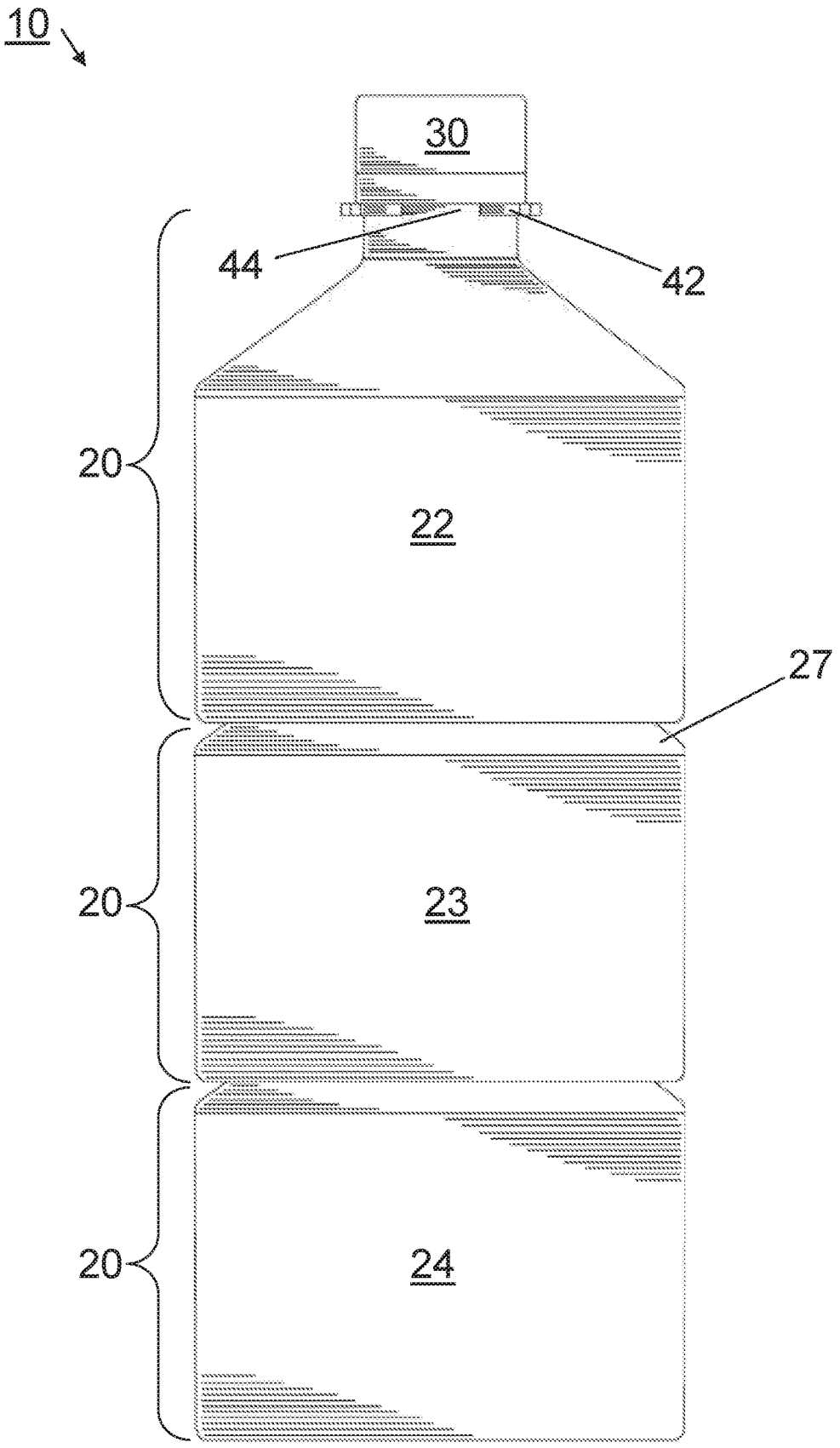
FIG. 2 is a side view of a storage system.
Figure 3:
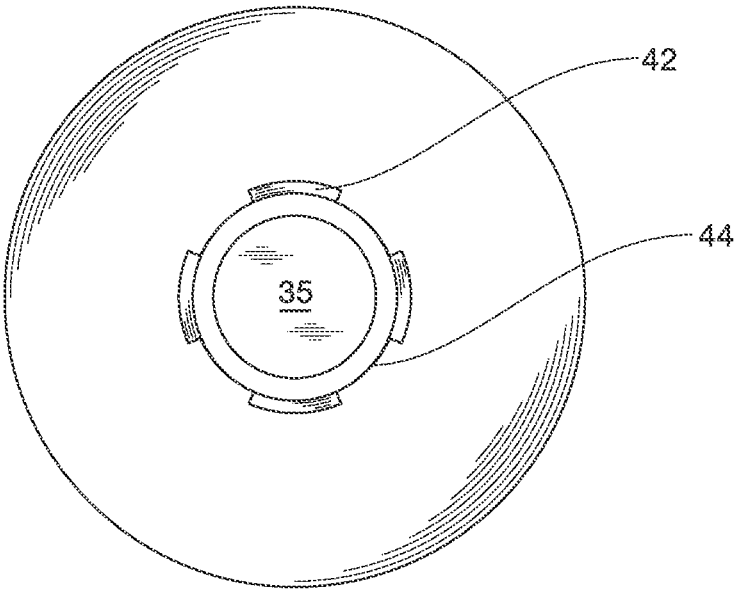
FIG. 3 is a top plan view of a vessel without a cap.
Figure 7:
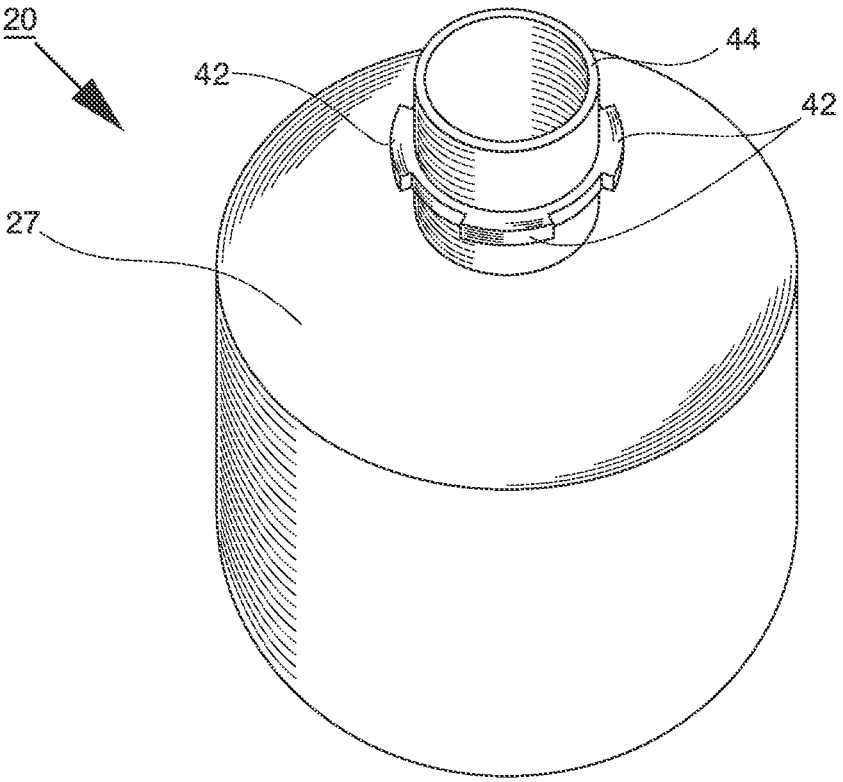
FIG. 7 is a top perspective view of a vessel without a cap.

Referring to FIG. 1, storage system 10 includes a plurality of vessels 20. This figure depicts three vessels, upper vessel 22, middle vessel 23 and lower vessel 24, but it should be understood that vessels 20 could be added or subtracted to yield a storage system having as few as two vessels, and as many as desired, although approximately 20 is the preferred upper limit. Each vessel may be identically sized and shaped and includes upper portion 26 and lower portion 28 (see FIG. 5). Upper portion 26 includes a plurality of outwardly projecting flanges 42 positioned radially around the lip with a plurality of interflange regions 44 separating each flange 42 one from the other. Flanges 42 and interflange regions 44 are depicted most clearly in FIGS. 3 and 7. Lip 40 defines a plurality of threads 41 for engaging cap 30.

Figure 5:
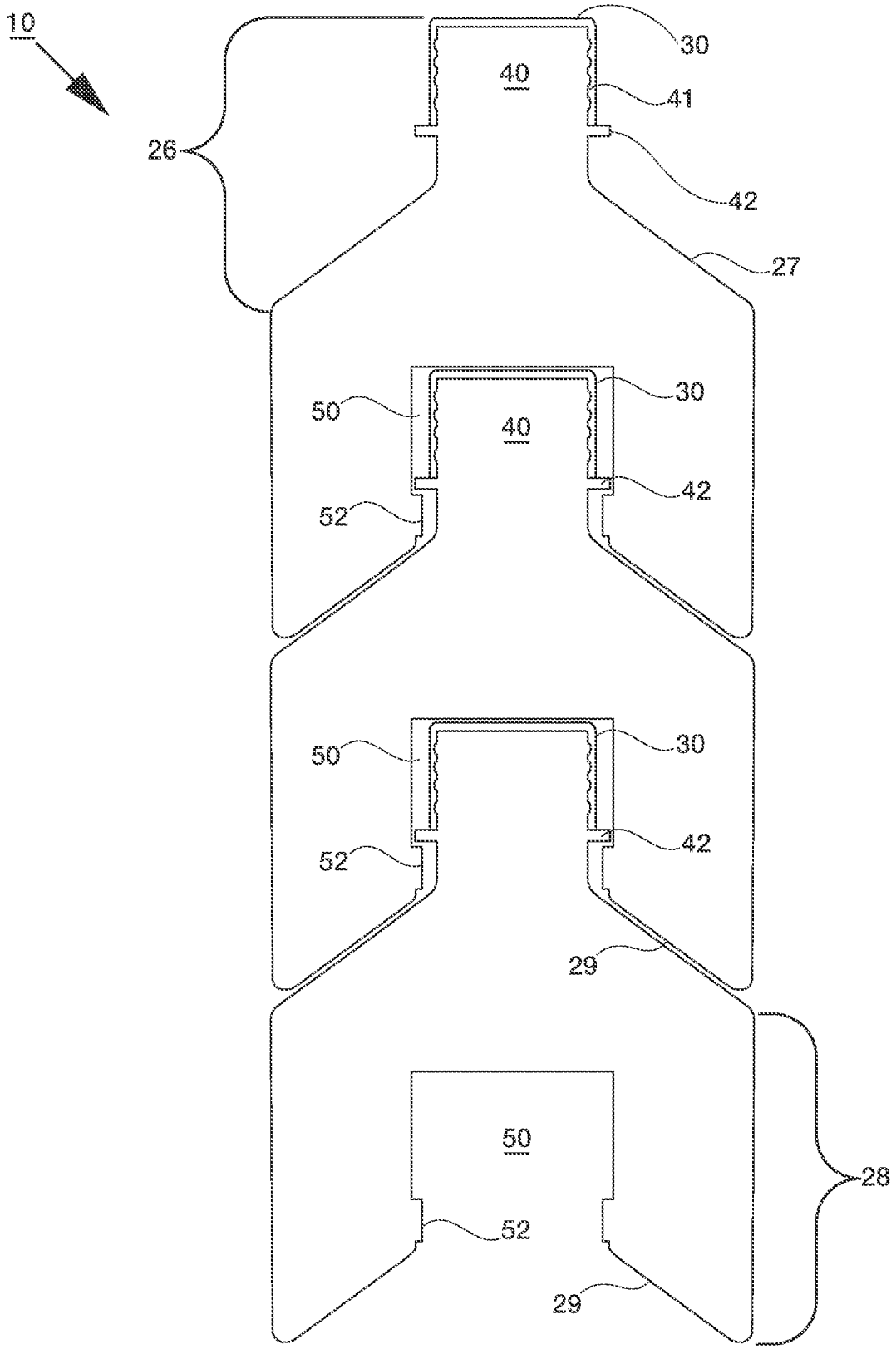
FIG. 5 is a cross-sectional side view of a storage system in a stacking and interlocking orientation.

As best shown in FIG. 5, lower portion 28 of each vessel defines depression 50, which is sized and shaped to receive lip 40, cap 30 and flanges 42 of adjoining vessel. Said another way, the upper portion of the immediately lower vessel fits within the lower portion of the upper vessel.

Figure 4:
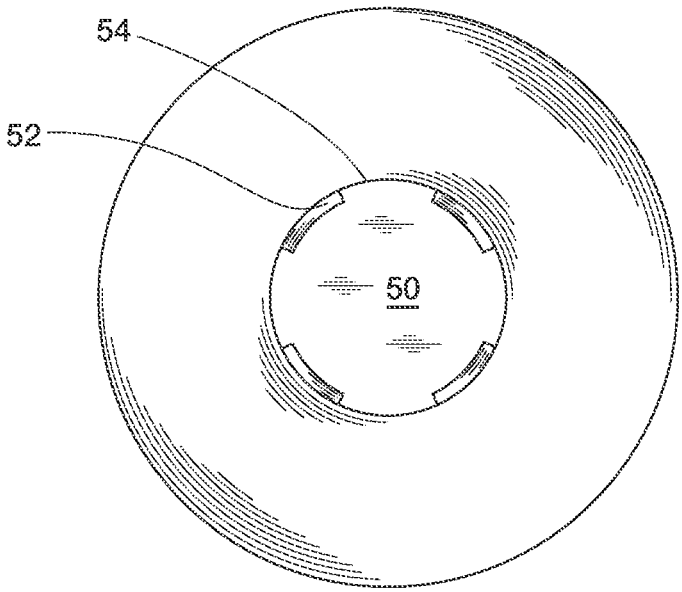
FIG. 4 is a bottom view of a vessel.
Figure 8:
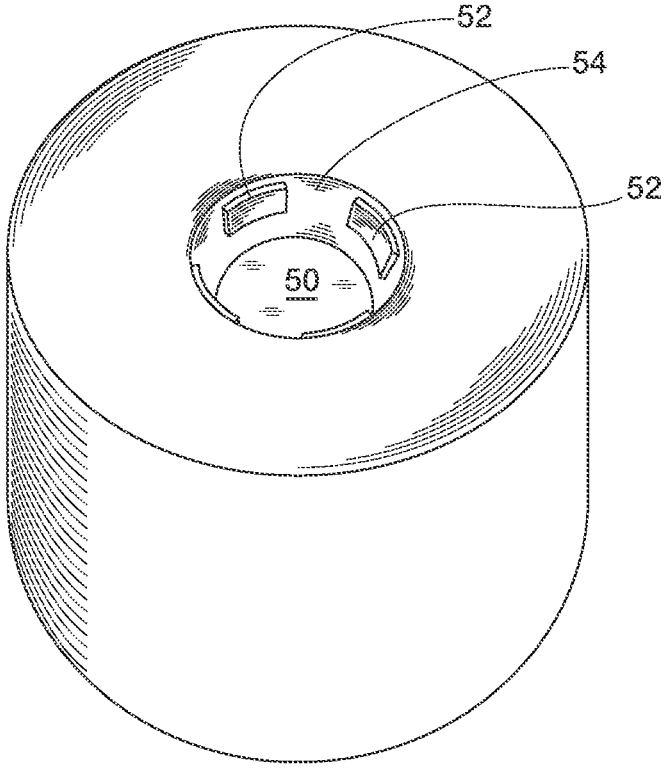
FIG. 8 is a perspective view of the bottom of a vessel.

Referring to FIGS. 4 and 8, depression 50 on bottom portion of vessel includes a plurality of inwardly projecting locking lugs 52 positioned radially. A plurality of interlug regions 54 separate each locking lug 52 one from the other. As shown best in FIG. 5, upper portion 26 defines upper tapering 27, which is substantially parallel with lower tapering 29 of lower portion 28.

Figure 6:
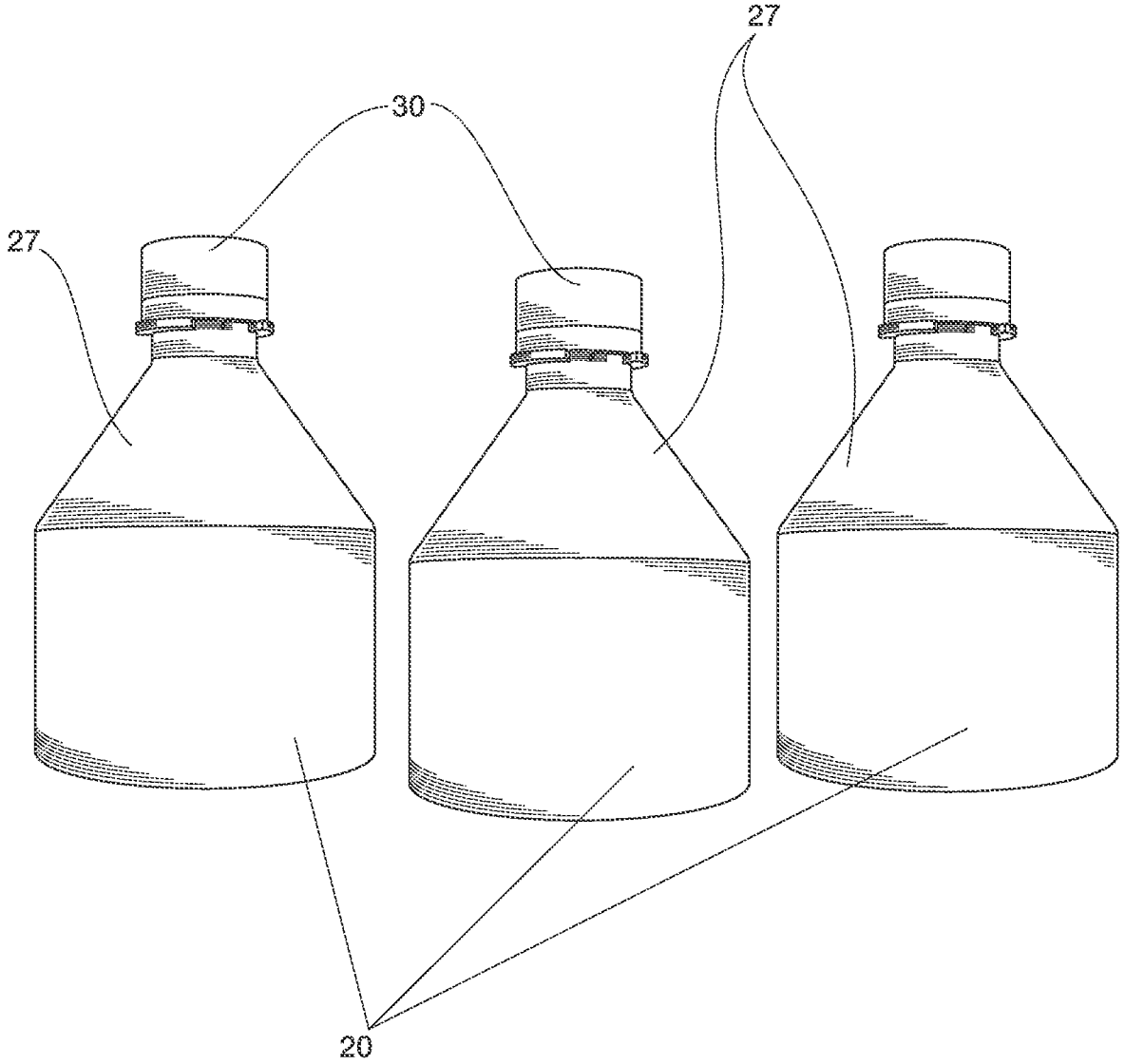
FIG. 6 depicts three capped vessels positioned separately.

Referring to FIG. 6, vessels 20 are fully independent and can be used in the normal manner. Alternatively, two or more vessels can be engaged in a stacking orientation by engaging flange 42 to locking lug 52 via rotation. Vessels are disengaged by rotating one vessel relative to another, so flanges and locking lugs are unlocked and freely pass through interlug region 54 and interflange region 44 respectively.

Interior cavity 35 of vessel 20 preferably has a volume of approximately 15 ml to 2 L, with a volume of approximately 220 ml to 500 ml being preferred. The volume of each vessel need not be identical.

Conventional manufacturing methods such as injection molding, blow molding, stretch molding and extrusion are suitable for producing the vessels of the present invention. Preferably the vessels include conventional thread patterns and employ commercially available caps. Vessels are preferably constructed of polyethylene terephthalate (PET), but could also be constructed of high-density Polyethylene (HDPE), polystyrene (PS), other plastics, as well as glass, stainless steel, aluminum, and other metals.

It should be understood that the foregoing relates to exemplary embodiments of the invention and that modifications may be made without departing from the spirit and scope of the invention as set forth in the following claims. By way of example, material, sizes, volumes and mechanisms can differ. Terms such as "substantially" and the like shall mean within reasonable bounds when considering limitations such as machines, materials, manufacturing methods, and people. By way of example, a "substantially smooth" surface means there are no intentional bumps or irregularities. All ranges set forth herein include the endpoints as well as all increments there between, even if not specifically stated. By way of example 1 to 2 inches includes 1 inch, 1.000001 inches and so forth. Finally, unless otherwise stated or contrary to common sense, "approximate" and the like shall mean +/−10%.

What is claimed is:

1. A storage system including:

A. An upper vessel having a first upper portion and a first lower portion and defining a first interior cavity, said first lower portion defining a first depression having a first right cylindrical wall, said first right cylindrical wall including a first plurality of locking lugs projecting perpendicularly inward relative to said first right cylindrical wall;

B. A middle vessel having a second upper portion and a second lower portion and defining a second interior cavity, said second upper portion defining a second plurality of outwardly projecting flanges oriented substantially parallel relative to said first plurality of locking lugs, said second plurality of outwardly projecting flanges releasably locked and unlocked with said first inwardly projecting locking lugs by rotating said upper vessel relative to said middle vessel, and said second lower portion defining a second depression having a second plurality of inwardly projecting locking lugs, wherein said first upper portion and said second upper portion are substantially identically sized and shaped;

C. A first removable cap engaged with said upper vessel; and

D. A second removable cap engaged with said middle vessel.

2. The storage system of claim 1 further including a lower vessel having a third upper portion and a third lower portion, said third upper portion defining a third plurality of outwardly projecting flanges releasably engaged with said second plurality of inward projecting locking lugs, wherein said third upper portion is substantially identically sized and shaped as said second upper portion.

3. The storage system of claim 1 wherein each upper portion defines downwardly sloped upper tapering.

4. The storage system of claim 3 wherein each lower portion defines downwardly sloped lower tapering.

5. The storage system of claim 4 wherein said upper tapering is substantially parallel with said lower tapering.

6. The storage system of claim 5 wherein said first interior cavity is not in fluid communication with said second interior cavity.

7. A method of storing materials within the storage system of claim 1 including the non-sequential steps of:

A. Filling said first interior cavity with a material;

B. Capping said upper vessel;

C. Filling said second interior cavity with a material;

D. Capping said middle vessel;

E. Positioning said second upper portion within said first depression; and

F. Engaging said first plurality of locking lugs with said second plurality of outwardly projecting flanges.

8. The method of claim 7 wherein said step of engaging said first plurality of locking lugs with said second plurality of outwardly projecting flanges includes the step of rotating said upper vessel relative to said middle vessel.

9. The method of claim 7 further including the step of filling an interior cavity of a lower vessel with a material, said lower vessel including a third upper portion defining a third plurality of outwardly projecting flanges.

10. The method of claim 9 further including the step of positioning said third upper portion within said second depression.

11. The method of claim 10 further including the step of engaging said second plurality of locking lugs with said third plurality of outwardly projecting flanges.

* * * * *